United States Patent [19]

Zajeski et al.

[11] Patent Number: 4,982,927

[45] Date of Patent: Jan. 8, 1991

[54] VERTICAL PRINTER STAND

[76] Inventors: Robert B. Zajeski, 25 Sunhill La., Lemont, Ill. 60439; Donald C. Wiencek, 16529 S 84th Ave., Tinley Park, Ill. 60477

[21] Appl. No.: 310,612

[22] Filed: Feb. 15, 1989

[51] Int. Cl.[5] ..... A47F 7/00

[52] U.S. Cl. ..... 248/674; 248/680; 248/241; 248/499; 400/691

[58] Field of Search ..... 248/674, 680, 681, 500, 248/300, 918, 551, 154, 235, 241, 247, 309.1, 313, 316.1, 499, 505; 211/187, 90; 108/135; 400/691, 693

[56] References Cited

U.S. PATENT DOCUMENTS

| | | | |
|---|---|---|---|
| Re. 28,035 | 6/1974 | Fork | 248/500 |
| 76,232 | 3/1868 | Morse | 248/235 |
| 1,851,131 | 3/1932 | Rowley | 400/691 |
| 3,128,979 | 4/1964 | Damelio | 248/680 |
| 3,182,804 | 5/1965 | Chades | 248/499 |
| 3,212,739 | 10/1965 | Morris | 248/681 |
| 3,664,616 | 5/1972 | Raskin | 400/691 |
| 3,850,392 | 11/1974 | Gassaway | 400/691 |
| 3,937,437 | 2/1976 | Stewart | 248/499 |
| 4,465,256 | 8/1984 | Wolbrink | 248/674 |
| 4,568,212 | 2/1986 | Cooke | 248/302 |
| 4,570,802 | 2/1986 | Murphy | 248/441.1 |
| 4,651,967 | 3/1987 | McCoy | 248/676 |
| 4,703,919 | 11/1987 | Drake | 248/677 |

*Primary Examiner*—David M. Purol
*Assistant Examiner*—Robert A. Olson

[57] ABSTRACT

The present invention comprises a unique method for mounting and supporting a printer used with personal computers. The invention, a Vertical Printer Stand, is comprised of a printer stand base, printer support brackets that support the printer in a vertical position, adhesive backed mounts that attach to the printer side walls, and straps that attach to the adhesive mounts and around the printer, securing the printer to the stand. The entire assembly is then typically mounted to the wall using standard wall mount fasteners, with the printer mounted parallel to the wall. The primary purpose of this invention is to remove the printer from the desk and free up valuable desk and office space. The paper may either feed from the floor, desk top, or from an optional paper feed tray.

12 Claims, 6 Drawing Sheets

VERTICAL PRINTER STAND

BACKGROUND TO THE INVENTION

The invention relates to printer stands and particularly to a Vertically Mounted Pinter Stand for printers used with personal computers.

The advent of personal computers in the office has produced an ever increasing demand for printers on every desk for hard copy outputs. Space limitations are inherent in the typical personal work space, with the relatively confined work space dictating new approaches to the handling of personal computer equipment and accessories.

Typical examples of prior art in printer stands are found in U.S. Pat. Nos. 4,703,919; 4,651,967; and 4,568,212. All of these patents approach the design of a printer stand, with various degrees of complexity, in a horizontal manner. The printer remains parallel to the desk occupying a maximum amount of desk space. The closest known prior art related to the invention is a printer stand as shown in U.S. Pat. No. 4,570,802. This printer stand mount the printer on an angle from the desk top of approximately 60 degrees minimizing the footprint of the printer of the desk, but still does not get the printer or the stand off the desk itself.

Another typical problem with personal computer printers is the handling of the paper. Numerous tray and bins designed for the efficient handling of paper exist, but paper feed problems persist, particularly with the paper exit where the paper has a tendency to wrap itself back into the feed section of the printer. By vertically mounting the printer in an upside down manner on the wall, the paper automatically falls away from the printer and printer feed area, guaranteeing the proper paper feed.

SUMMARY OF THE INVENTION

Our invention, a Vertically Mounted Printer Stand, in one embodiment consists of the following components: (1) the base which is the backbone of the assembly and is capable of accommodating a variety of printer sizes (2) two printer supports that attach to the bottom of the base and which support most of the printer weight when mounted to the wall (3) four adhesive backed mounts that attach to the sides of the printer that are designed to secure the straps to the assembly (4) two straps which secure the printer to the base by attaching to the four adhesive backed mounts and around the base, (5) two wall mounts that the base mounts to, attaching the entire assembly to the wall.

The typical mounting procedure is as follows. After determining the desired location of the printer on the wall, the base is held against the wall and the mounting hole locations are marked. The hole centers are located 16 inches apart allowing the user to mount the printer directly into the wall studs if they so desire. Properly sized holes are then drilled into the wall and the wall mounts are either attached to the wall studs or wall board.

The two straps are first assembled to the support base by threading the straps through the strap slots located on the base. The base containing multiple mounting key holes compatible with the printer support is first laid on a flat surface with the printer placed on top of it. The two printer supports are located by finding an unobstructed area on the bottom of the printer that most closely aligns with the printer support mounting key holes on the base. The printer supports are then attached to the support base through the appropriate key holes on the base. Next the adhesive backed printer mounts are attached to an unobstructed area on the side walls of the printer on both sides and at equal distances from the normal back of the printer. One end of each of the two straps is attached to one of the two adhesive mounts and secured. The other end of the two straps is then attached to the other adhesive mount, and the strap length adjusted to securely tighten the printer to the printer stand. The printer stand assembly, complete with the printer, is placed on the wall mounts through the key hole slots on the base.

DETAILED DESCRIPTION OF THE INVENTION

Figure 1:
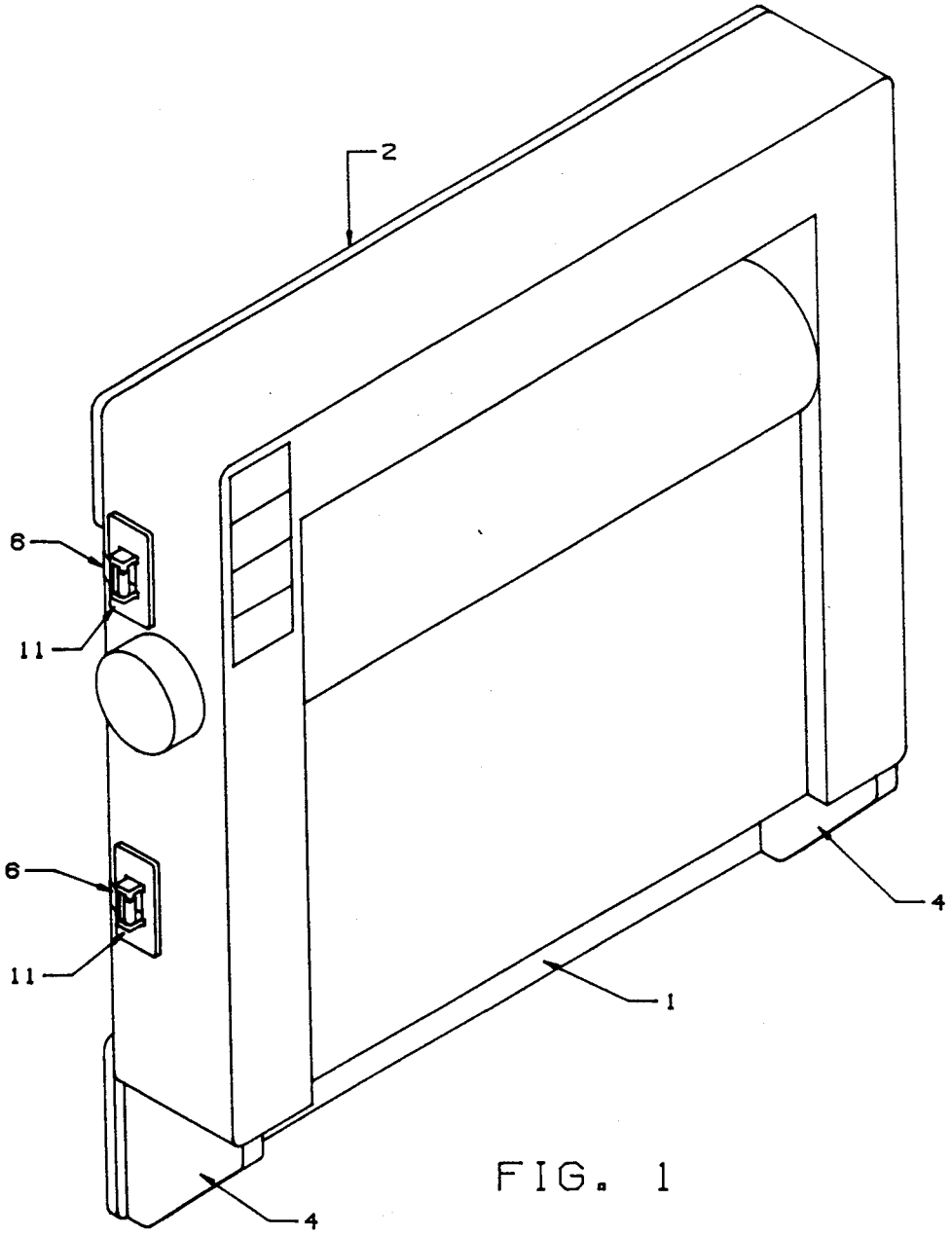
FIG. 1 is a isometric view of the printer stand as it would appear attached to the printer, illustrating the printer position in relation to the wall.

FIG. 1 shows an isometric view of the preferred embodiment of the Vertical Printer Stand 1 mounted to a computer printer and as would appear as mounted on a wall.

Figure 2:
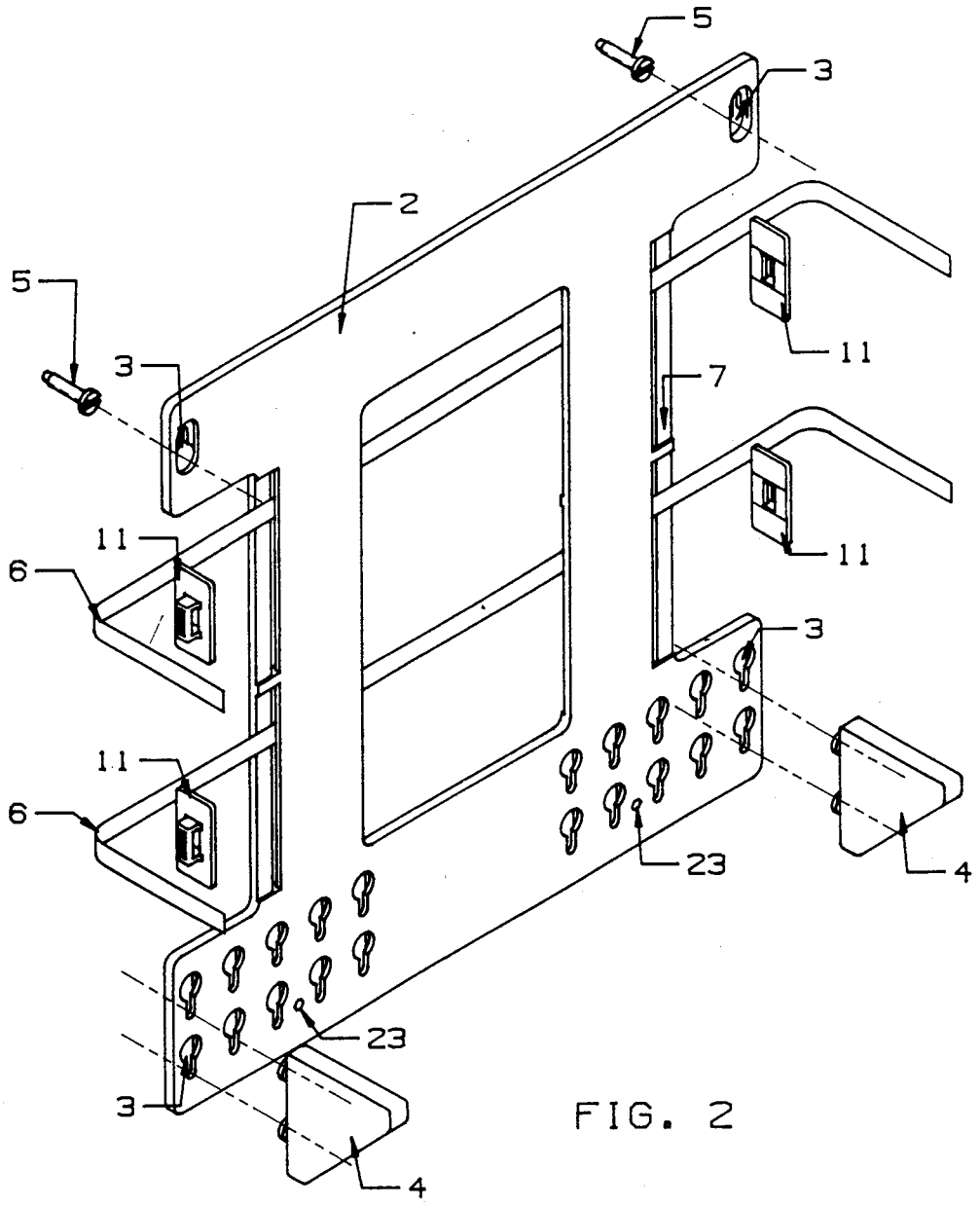
FIG. 2 is an isometric view of an exploded assembly of the printer stand without the printer, illustrating the assembly of the printer stand.
Figure 3:
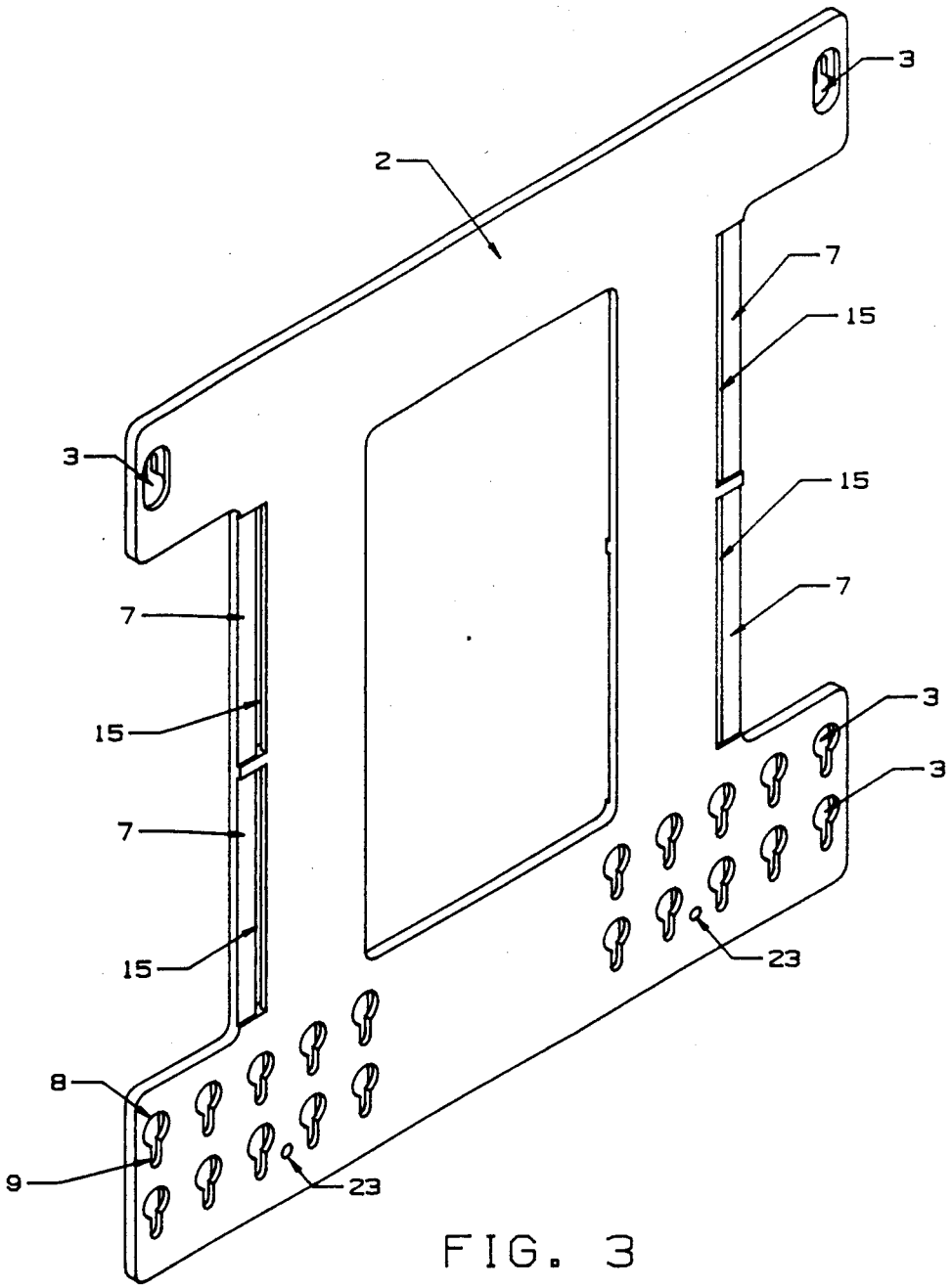
FIG. 3 is a detailed view of the base, illustrating the mounting key holes for the printer supports and the wall mounts, and the strap slots.

Referring to FIG. 2. here is shown an exploded view of the same Vertical Printer Stand 1 highlighting the various components of the invention. The major structural member of the printer stand is the Base 2. The Base 2 contains Mounting Key Holes 3 for the Printer Supports 4 and the Wall Mounts 5 and Strap Slots 15 for the Straps 6. The multiple Mounting Key Holes 3 located on the bottom of the Base 2 enable the Vertical Printer Stand 1 to adjust to a wide range of printers with varying widths. See FIG. 3. The Strap Relief 7 of the Base 2 allow clearance for the Straps 6 when assembly is complete.

Also shown in FIG. 2 are the Printer Supports 4. These Printer Supports 4 attach to the Mounting Key Holes 3 of the Base 2, the Keyed Studs 10 slipping into the Stud Opening 8 of the Mounting Key Holes 3 and sliding down into the Support Slots 9 of the Mounting Key Holes 3. The Printer Supports 4 major function is to support most of the printer weight when the entire assembly is hanging on the wall. The Mounting Key Holes 3 located at the top of the Base 2 are used to mount the entire assembly on the Wall Mounts 5 and to the wall.

Figure 5:
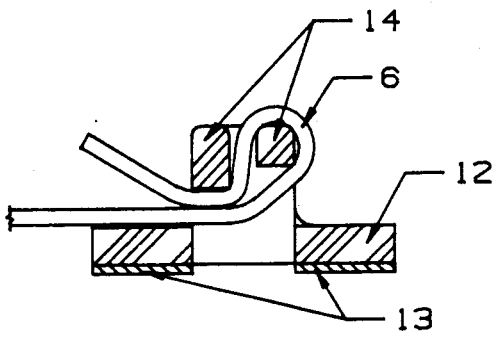
FIG. 5 is a section view of the adhesive backed mount and the strap, illustrating the assembly of the strap and mount.

To secure the printer to the Vertical Printer Stand 1 the Adhesive Backed Mounts 11 are attached to the side walls of the printer, preferably two to each side. See FIG. 1. The Adhesive Backed Mounts 11 consist of the Mount 12 itself and a strip of Double Backed Adhesive Tape 13. See FIG. 5. The Mount 12 is essentially a flat piece with with two Parallel Beams 14 arranged in such a manner to secure the Strap 6 to the Adhesive Backed Mount 11.

To secure the printer to the Vertical Printer Stand 1, the two Straps 6 are attached to the Adhesive Backed Mounts 11 previously attached to the printer side walls and fed through the Strap Slots 15 of the Base 2. The other end of the Straps 6 are then attached to the two remaining Adhesive Backed Mounts 11 secured to the other side of the printer. The Strap 6 is adjusted by pulling the free end through the Parallel Beams 14 until the proper tension is achieved. The entire assembly is then mounted to the wall and the Wall Mounts 5 through the Mounting Key Holes 3 of the Base 2. The Printer Supports 4 provide the main load support of the printer weight, with the Straps 6 securing the printer to the Vertical Printer Stand 1.

Figure 6:
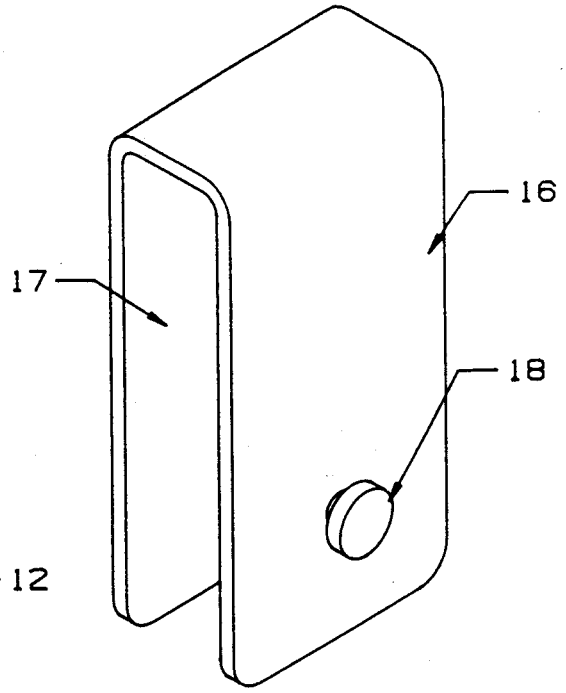
FIG. 6 is an isometric view of an additional piece to the basic printer stand that allows mounting to a wall divider used in modular office furniture.
Figure 4:
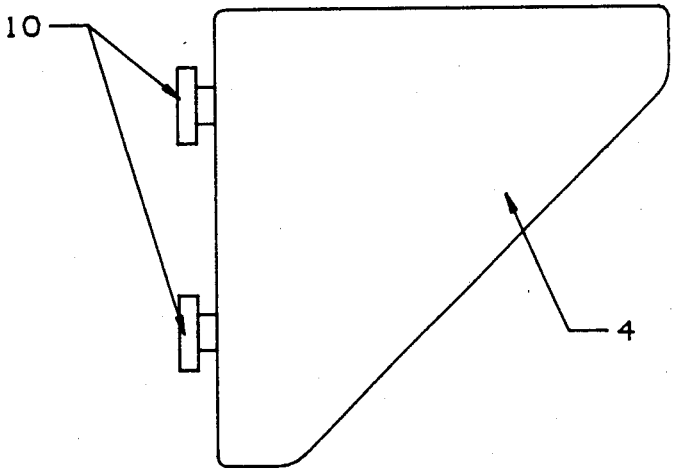
FIG. 4 is an side view of the printer support.

One option availabe for the Vertical Printer Stand 1 is a Wall Divider Mount 16. The Wall Divider Mount 16 shwon in FIG. 6. consist of a basically U-Shaped Base 17 with two Keyed Studs 10 designed to mount to the Mounting Key Holes 3 of the Base 2. The Wall Divider Mount 16 typically would slide down and over the top of a wall divider found in modular office furniture where wall mounts are not acceptable.

Figure 7:
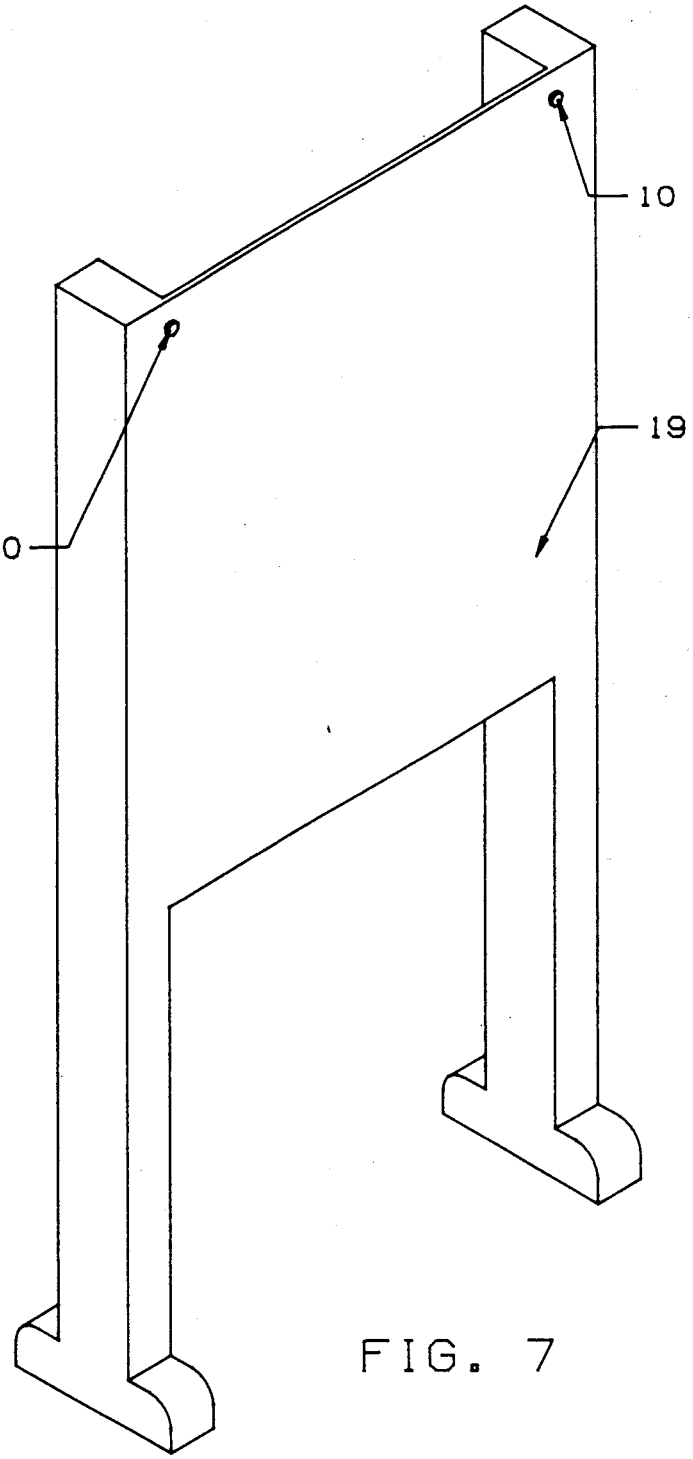
FIG. 7 is an isometric view of an optional floor stand that allows the basic printer stand to mount anywhere in the office.

Another option is a Floor Stand 19 as shown in FIG. 7. The Floor Stand 19 consist of a frame that stands freely on the floor and two Keyed studs 10 that mount to the Mounting Key Holes 3 of the Base 2. The Floor Stand 19 would be used when a conveniently located wall or divider could not be found.

Figure 8:
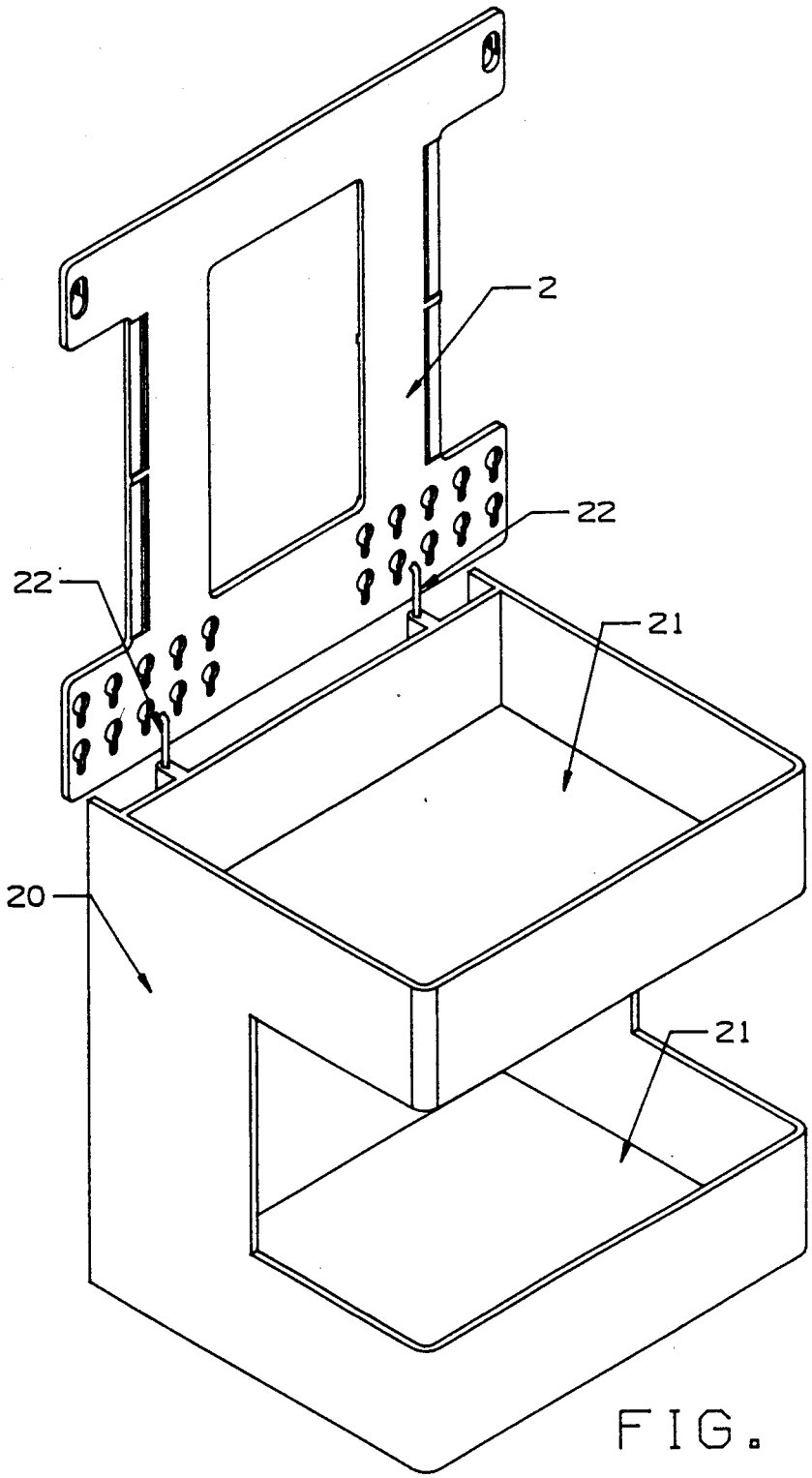
FIG. 8 is an isometric view of the base and an optional paper tray.

The final option detailed here is a Paper Tray 20 designed for use with the Vertical Printer Stand 1. See FIG. 8. The Paper Tray 20 consist of two Bins 21, one for holding new paper and one for holding printed paper. The Bins 21, made from either plastic or wire form constuction, can be attached to the Vertical Printer Stand 1 in numerous ways, most simply by attaching Brackets 22 from the Bins 21 to the Base 2 of the Vertical Printer Stand 1.

While one preferred embodiment of the invention is detailed, it will be understood of course that the invention is not limited to this one embodiment. Other practical assemblies that would obviously perform the same function, that is the vertical mounting of a printer, are also intended to be covered under this invention.

What is claimed is:

1. A mounting means for vertically supporting a computer printer or other similar electronic office equipment comprising:

(a) a base including printer support mounting holes at numerous locations along a bottom of the base, two mounting holes capable of securing the base to a vertical structure such as a wall through the use of some standard mounting means such as a screw, strap slots capable of accepting and securing a strapping means to the base, and paper bin mounting holes near the bottom of the base;

(b) two printer supports each consisting of two keyed studs capable of securing the printer supports to the printer support mounting holes; a top surface of the printer support being of sufficient size to support most printers; with the printer supports mounted to the base and adapted to support most of the printer weight;

(c) four adhesive backed mounts comprising an essentially flat piece with double backed adhesive tape attached to a flat end of the mount with a other side of the tape available for securing the mount to the printer side wall, and an extension consisting of two parallel beams arranged in such a manner to secure a strapping means to the adhesive backed mount;

(d) two straps constructed of sufficient length, flexibility and strength to wrap around a printer and through the strap slots on the base, securing to the adhesive backed mounts previously attached to both sides of a printer, completing the assembly of the printer to the printer stand.

2. A mounting means as in claim 1 wherein the base is mounted to a wall divider adapter, the wall divider adapter consisting of a generally U shape piece that is adapted to slide over the top of a wall divider, and two keyed studs that match the mounting holes of the base.

3. A mounting means as in claim 1 wherein the base is mounted to a floor mount, the floor mount consisting of two vertical legs of sufficient length attached to floor mount supports, and at the top of the vertical legs a mounting plate containing two keyed studs that match the mounting holes of the base.

4. A mounting means as in claim 1 including a paper bin comprising two bins, one bin for holding paper to be printed and one bin for holding printed paper, and extensions from the top bin matching the paper bin mounting means of the base and attaching below the printer supports to the base.

5. A mounting means for vertically supporting a computer printer or other similar electronic office equipment comprising:

(a) a base including printer support mounting holes at numerous locations along a bottom of the base, two mounting holes capable of securing the base to a vertical structure such as a wall through the use of some standard mounting means such as a screw, strap slots capable of accepting and securing a strapping means to the base, and paper bin mounting holes near the bottom of the base;

(b) two printer supports each consisting of two keyed studs capable of securing the printer supports to the printer support mounting holes, a top surface of the printer support being of sufficient size to support most printers, with the printer supports mounted to the base and adapted to support most of the printer weight;

(c) two strap assemblies consisting of a strap constucted of sufficient length, flexibility and strength to wrap around the back of a priner and through the strap slots on the base, and a standard buckle allowing for adjustability and locking of the strap around the printer assembly; completing the assembly of the printer to the printer.

6. A mounting means as in claim 5 wherein the base is mounted to a wall divider adapter, the wall divider adapter consisting of a generally U shape piece that is adapted to slide over the top of a wall divider, and two keyed studs that match the mounting holes of the base.

7. A mounting means as in claim 5 base wherein the base is mounted to a floor mount, the floor mount consisting of two vertical legs of sufficient length attached to floor mount supports, and at the top of the vertical legs a mounting plate containing two keyed studs that match the mounting holes of the base.

8. A mounting means as in claim 5 including a paper bin comprising two bins, one bin for holding paper to be printed and one bin for holding printed paper, and extensions from the top bin matching the paper bin mounting means of the base and attaching below the printer supports to the base.

9. A mounting means for vertically supporting a computer printer or other similar electronic office equipment comprinsing:

(a) two bases including two printter support mounting holes, two mounting holes capable of securing the base to a vertical structure such as a wall through the use of some standard mounting means such as a screw, planar depressions on the back of the base cpable of accepting and securing and strapping means to the base, and paper bin mounting holes near a bottom of the base;

(b) two printer supports consisting of two keyed studs capable of securing the printer supports to the base mounting holes, a top surface of the printer support being of sufficient size to support most printers, with the printer supports mounted to the base adapted to support most of the printer weight;

(c) two strap assemblies consisting of a strap constucted of sufficient length, flexibility and strength to wrap around the back of a printer and behind the strap depressions of the base; and a standard buckle allowing for adjustability and locking of the strap around the printer assembly, completing the assembly of the printer to the printer.

10. A mounting means as in claim 9 wherein the base is mounted to a wall divider adapter, the wall divider adapter consisting of a generally U shape piece that is adapted to slide over the top of a wall divider, and two keyed studs that match the mounting holes of the base.

11. A mounting means as in claim 9 wherein the base is mounted to a floor mount, the floor mount consisting of two vertical legs of sufficient length attached to floor mount supports, and at the top of the vertical legs a mounting plate containing two keyed studs that match the mounting holes of the base.

12. A mounting means as in claim 9 including a paper bin comprising two bins, one bin for holding paper to be printed and one bin for holding printed paper, and extensions from the top bin matching the paper bin mounting means of the base and attaching below the printer supports to the base.

* * * * *